US007011150B2

(12) United States Patent
Komatsubara et al.

(10) Patent No.: US 7,011,150 B2
(45) Date of Patent: Mar. 14, 2006

(54) TUBE STRUCTURE OF MULTITUBULAR HEAT EXCHANGER

(75) Inventors: Tamio Komatsubara, Kanagawa (JP); Hirokazu Yokoyama, Kanagawa (JP); Noboru Shirako, Kanagawa (JP)

(73) Assignee: Tokyo Radiator Mfg. Co., Ltd., Kanagawa (JP)

( * ) Notice: Subject to any disclaimer, the term of this patent is extended or adjusted under 35 U.S.C. 154(b) by 0 days.

(21) Appl. No.: 10/827,413

(22) Filed: Apr. 20, 2004

(65) Prior Publication Data

US 2005/0230094 A1 Oct. 20, 2005

(51) Int. Cl.
*F28F 1/42* (2006.01)

(52) U.S. Cl. ..... 165/177; 165/179

(58) Field of Classification Search ..... 165/177, 165/179, DIG. 527
See application file for complete search history.

(56) References Cited

U.S. PATENT DOCUMENTS 4,470,452 A * 9/1984 Rhodes ..... 165/179
4,585,059 A * 4/1986 Lee ..... 165/154
4,690,211 A * 9/1987 Kuwahara et al. ..... 165/177
5,375,654 A * 12/1994 Hougland et al. ..... 165/177
5,577,555 A * 11/1996 Hisajima et al. ..... 165/179
5,839,505 A * 11/1998 Ludwig et al. ..... 165/177
5,950,716 A * 9/1999 Appelquist et al. ..... 165/403
5,960,870 A * 10/1999 Takahashi et al. ..... 165/177
6,488,078 B1 * 12/2002 Beutler et al. ..... 165/179

FOREIGN PATENT DOCUMENTS

JP 2000-345925 A 12/2000
JP 2004-85090 A 3/2004

* cited by examiner

*Primary Examiner*—Teresa J. Walberg
(74) *Attorney, Agent, or Firm*—Sughrue Mion, PLLC

(57) ABSTRACT

A plurality of beads protruding from an inner face of the tube are provided in such a manner that the beads are arranged at a predetermined pitch in an axial direction of the tube; and a circumference of the tube is divided at least into thirds, and the beads are aligned in a circumferential direction of the tube; and the beads aligned in the circumferential direction of the tube are provided at plural rows at the predetermined pitch in the axial direction of the tube, and the beads adjoining in the axial direction are shifted by substantially a half of a circumferential length of the bead to one another. Alternatively, the circumference of the tube is divided into parts of an even number of four or more, and the beads are aligned in the circumferential direction so as to be alternately formed in the parts of the circumference.

20 Claims, 9 Drawing Sheets

CROSS SECTION I-I

CROSS SECTION II-II

CROSS SECTION I-I

CROSS SECTION II-II

CROSS SECTION I-I

CROSS SECTION I-I

CROSS SECTION II-II

CROSS SECTION I-I

CROSS SECTION II-II

| | |
|---|---|
| D ; INNER DIAMETER OF TUBE | 5mm TO 30mm |
| e ; BEAD HEIGHT | 0.05D TO 0.2D |
| P ; BEAD PITCH | 6e TO 25e |

TUBE STRUCTURE OF MULTITUBULAR HEAT EXCHANGER

BACKGROUND OF THE INVENTION

1. Field of the Invention

The present invention relates to a tube structure of a multitubular heat exchanger, the heat exchange performance of which is enhanced and the flow resistance in the tube of which is reduced.

2. Description of the Related Art

Conventionally, in order to enhance the performance of a multitubular heat exchanger such as an EGR gas cooler or an exhaust heat recovery device for a co-generator in which fluid of low Prandtl Number such as water, air or exhaust gas is used as a medium, for example, in order to enhance the performance of a heat exchanger: in which a large number of tubes for cooling EGR gas are arranged in parallel (This heat exchanger will be referred to as an EGR cooler hereinafter.), as shown in FIGS. 16 to 18, protrusions protruding to the center of a tube are provided on the inner face of the tube at regular intervals in the axial direction. These protrusions will be referred to as beads in this specification, hereinafter.

Concerning the form of protruding the beads 2 from the inner surface of the tube 1, according to the method of press forming the beads 2, the following two cases are provided. One is a case in which the beads 2 are two-dimensionally protruded from the inner face of the tube on the circumference as shown in FIG. 16. The other is a case in which the beads 3 are spirally protruded from the inner face of the tube as shown in FIG. 17 or Unexamined Japanese Patent Publication No. 2000-345925. There is a small difference between the performance of these two cases.

The beads 2, 3 protruding from the inner face of the tube are bodies for facilitating the generation of a turbulent flow in the fluid flowing in the tube. Therefore, the heat transfer effect of the beads 2, 3 is high. However, when a flow rate of the exhaust gas is increased, the pressure loss in the tube is also increased.

Further, there is provided a tube structure in which the spiral fin 4 is arranged in the tube 1 having the beads 2 so that the heat radiating performance can be enhanced as shown in FIG. 18. This spiral fin 4 contributes to the enhancement of the heat radiating performance. However, an increase in the pressure loss in the tube is caused when this spiral fin 4 is arranged in the tube.

Therefore, it is desired to develop a tube structure capable of satisfying both the enhancement of the heat radiating performance and the reduction of the pressure loss in the tube so that the tube structure can meet the needs in the future.

SUMMARY OF THE INVENTION

The present invention has been accomplished to solve the above problems of the related art. It is a technical task of the invention to provide a tube structure of a multitubular heat exchanger capable of optimizing the heat radiating performance and the pressure loss in the tube even when the regulation of exhaust gas and the regulation of fuel consumption are more intensified.

As a specific means for effectively solving the above problems, the present invention according to a first aspect of the invention provides a tube structure of a multitubular heat exchanger comprises a tube and a plurality of beads protruding from an inner face of the tube, wherein the beads are arranged at a predetermined pitch in an axial direction of the tube; and a circumference of the tube is divided at least into thirds, and the beads are aligned in a circumferential direction of the tube; and the beads aligned in the circumferential direction of the tube are provided at plural rows at the predetermined pitch in the axial direction of the tube, and the beads adjoining in the axial direction are shifted by substantially a half of a circumferential length of the bead to one another. By virtue of the foregoing, the shape and the arranging method of the bead, which is a body for facilitating the generation of a turbulent flow, are determined in such a manner that the beads are divided into three or more parts in the circumferential direction and the adjoining beads in the axial direction are arranged so that the phases can be shifted from each other. Therefore, when a flow rate in the tube is low, the heat radiating performance can be enhanced by the effect of facilitating the generation of a turbulent flow while the pressure loss is being maintained to be the same as that of the conventional case in which the beads are uniformly formed on the circumference. As the flow rate in the tube is increased, the heat radiating performance is the same as or lower than that of the conventional tube in which the beads are uniformly formed on the circumference. However, concerning the pressure loss, since the beads are divided, a portion of high pressure generated on the downstream side of the bead is decreased when the beads are divided. Therefore, the pressure loss can be greatly reduced.

The invention according to a second aspect of the invention provides a tube structure of a multitubular heat exchanger, wherein the circumference of the tube is divided into parts of an even number of four or more, and the beads are aligned in the circumferential direction so as to be alternately formed in the parts of the circumference. By virtue of the foregoing, the dividing number becomes divisible. Therefore, the tube can be easily manufactured, that is, the tube can be manufactured at a low manufacturing cost although the number of beads is relatively large.

The invention according to a third aspect of the invention provides a tube structure of a multitubular heat exchanger, wherein the beads are inclined by an angle of not more than 45° with respect to the circumferential direction of the tube. By virtue of the foregoing, the beads formed divided into three or more equal parts in the circumferential direction are appropriately inclined with respect to the circumferential direction. Therefore, the flow passage resistance caused by the beads, which are bodies for facilitating the generation of a turbulent flow for the exhaust gas, can be reduced and the pressure loss in the tube can be effectively decreased.

The invention according to a fourth aspect of the invention provides a tube structure of a multitubular heat exchanger comprises a tube, wherein the circumference of the tube is divided into parts of an even number of four or more, and the beads are aligned in the circumferential direction so as to be alternately formed in the parts of the circumference. By virtue of the foregoing, the shape and the arranging method of the beads, which are bodies for facilitating the generation of a turbulent flow, are determined in such a manner that the beads are formed being shifted in the circumferential direction by the length of the bead in the circumferential direction between the beads, which are adjacent to each other at the different positions in the axial direction, and the beads, which are provided on the circumference at the intermediate position of the beads. Therefore, a distance between the adjoining beads at different positions in the axial direction can be extended. Accordingly, the heat radiating performance can be enhanced in the case of a low flow rate, and the pressure loss can be effectively reduced in the case of a high flow rate.

The invention according to a fifth aspect of the invention provides a tube structure of a multitubular heat exchanger, wherein wherein the beads are inclined by an angle of not more than 45° with respect to the circumferential direction of the tube. By virtue of the foregoing, the beads, which are divided into equal parts by an even number in the circumferential direction, are effectively inclined with respect to the circumferential direction. Therefore, the flow passage resistance caused by the beads, which are bodies for facilitating the generation of a turbulent flow of the exhaust gas, can be reduced and the pressure loss in the tube can be effectively decreased.

The invention according to a sixth aspect of the invention provides a tube structure of a multitubular heat exchanger, wherein inclinations of the beads which are adjacent to each other in the circumferential direction, are made to be opposite. By virtue of the foregoing, the heat transfer facilitating effect can be effectively enhanced without increasing the resisting action of the beads which are bodies for facilitating the generation of a turbulent flow of the exhaust gas. Further, the tube structure of a multitubular heat exchanger, inclinations of the beads which are adjacent to each other in the circumferential direction, may be made to be opposite. Further, the beads may be alternately aligned along the axial direction at substantially a half of the predetermined pitch.

The invention according to a seventh aspect of the invention provides a tube structure of a multitubular heat exchanger, wherein a bead height e with respect to an inner diameter D of the tube is set at e=0.05D to 0.2D and a bead pitch P with respect to the bead height e is set at P=6e to 25e; and the inner diameter D is 5 to 30 mm. By virtue of the foregoing, the beads of the most appropriate dimensions for the condition of use, in which a flow rate of the exhaust gas greatly fluctuates, can be formed. Accordingly, the heat radiating performance can be enhanced in the case of a low flow rate of the exhaust gas passing in the tube, and the pressure loss can be effectively reduced in the case of a high flow rate.

Further, A tube structure of a multitubular heat exchanger comprising a tube, an inner surface of which is divided into parts of an even number of four or more; and beads aligned along the axial direction at a predetermined pitch in each part of the inner face, wherein the beads are alternately arranged in the adjacent parts of the inner face of the tube can be provided. The above aspects can be applied to this structure.

BRIEF DESCRIPTION OF THE DRAWINGS

In the accompanying drawings:

FIG. 1 is a schematic illustration showing a tube structure of a multitubular heat exchanger of the first embodiment of the present invention, wherein

FIG. 2 is a cross-sectional view of a bead forming portion in the tube structure of the multitubular heat exchanger of the first embodiment of the present invention, wherein

FIG. 3 is a schematic illustration showing a tube structure of a multitubular heat exchanger of the second embodiment of the present invention, wherein

FIG. 4 is a cross-sectional view of a bead forming portion in the tube structure of the multitubular heat exchanger of the second embodiment of the present invention, wherein

FIG. 5 is a schematic illustration showing a tube structure of a multitubular heat exchanger of the third embodiment of the present invention, wherein

FIG. 7 is a schematic illustration showing a tube structure of a multitubular heat exchanger of the fourth embodiment of the present invention, wherein

FIG. 8 is a cross-sectional view of a bead forming portion in the tube structure of the multitubular heat exchanger of the fourth embodiment of the present invention, wherein

FIGS. 9A through 9C are schematic illustrations showing a tube structure of a multitubular heat exchanger of the fifth embodiment of the present invention, wherein

FIG. 10 is a cross-sectional view of a bead forming portion in the tube structure of the multitubular heat exchanger of the fifth embodiment of the present invention, wherein

FIG. 16 is a schematic illustration showing a tube having two-dimensional protrusion beads in the conventional tube structure of the multitubular heat exchanger, wherein

FIG. 17 is a schematic illustration showing a tube having spiral protrusion beads in the conventional tube structure of the multitubular heat exchanger, wherein FIG. 18 is a schematic illustration showing a tube having protrusion beads attached with spiral fins in the conventional tube structure of the multitubular heat exchanger, wherein

DETAILED DESCRIPTION OF THE PREFERRED EMBODIMENTS

An embodiment of the present invention will be specifically explained as follows.

However, it should be noted that this embodiment is explained for the better understanding of the present invention. Therefore, the present invention is not limited to this embodiment as long as specific remarks are not made.

Like reference marks are used to indicate like parts in the related art and this embodiment, and the explanations are omitted here.

First Embodiment

Figure 1A:
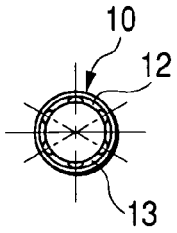
FIG. 1A is a front view.
Figure 1B:
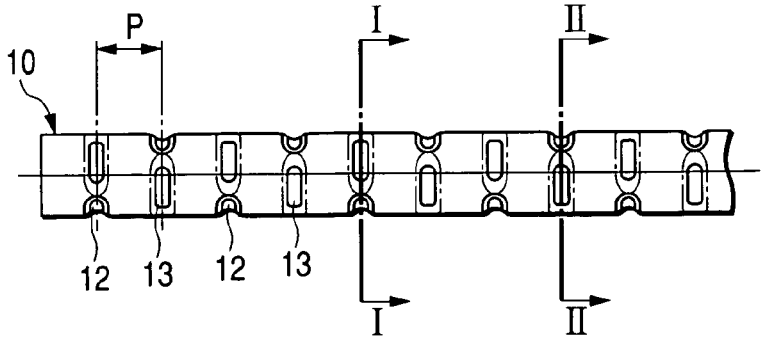
FIG. 1B is a side view and FIG. 1C is a development showing a bead pattern.
Figure 1C:
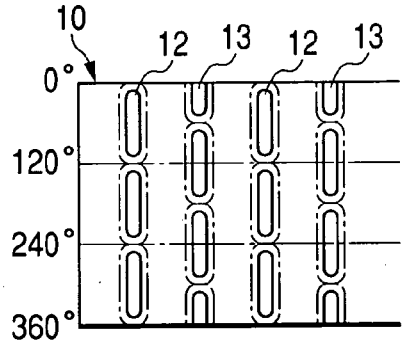
Figure 2A:
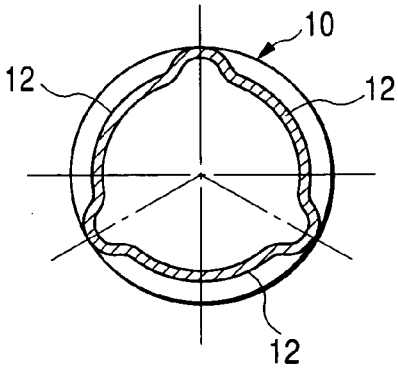
FIG. 2A is a sectional view taken on line I—I in FIG. 1B.
Figure 2B:
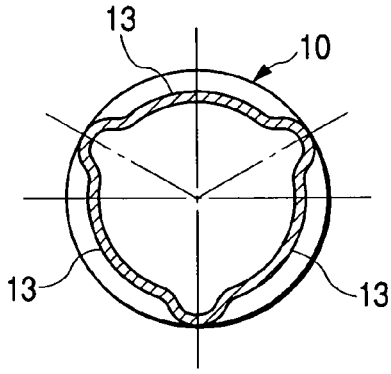
FIG. 2B is a sectional view taken on line II—II in FIG. 1B.

As shown in FIGS. 1 and 2, the tube structure of the multitubular heat exchanger of the first embodiment is composed as follows. The beads 12 are provided at the same position in the axial direction in the tube 10 and protruded from the inner face of the tube 10 in such a manner that the circumferential length is divided into three equal parts so as to form the beads 12. The beads 13, which are adjacent to the beads 12 at a different position in the axial direction, are provided in such a manner that the positions of the beads 13 with respect to the positions of the beads 12 are shifted in the circumferential direction by a half of the length of the bead 12 formed in such a manner that the circumference is divided into three equal parts, that is, the positions of the beads 13 with respect to the positions of the beads 12 are shifted in the circumferential direction by an angle corresponding to the central angle of the portion divided into six equal parts on the circumference.

Since the beads 12, 13 are provided as described above, when the tube 10 is developed into a plane as shown in FIG. 1C, the beads 12 and the beads 13 are alternately arranged in the longitudinal direction of the tube 10, and the beads 12 and the beads 13, which are adjacent to each other in the axial direction, are arranged being shifted in the circumferential direction by a half of the bead length in the circumferential direction.

In general, in the case where two-dimensional protrusions are provided, a portion in which the flow becomes stagnant is generated right after the protrusions. In this portion, the heat transfer performance is deteriorated, and the pressure loss is increased when the pressure is increased. When a flow rate in the tube is reduced, the boundary layer is developed. Therefore, when the height of the protrusions is embedded in this boundary layer, the flow in the tube becomes the same as the flow in a smooth circular tube. In order to prevent the occurrence of this phenomenon, it is necessary to increase the height of the protrusions. However, when the beads are formed, the property of press forming is limited. Further, when the height of the beads is increased, the pressure loss is also increased.

Therefore, as shown in FIG. 1, the two-dimensional protrusions are formed into the beads 12, 13 which are formed in such a manner that the circumference is divided in the circumferential direction, and portions of high pressure are generated after the beads 12, 13, and portions of low pressure, in which the beads 12, 13 are not located, are generated. Accordingly, fluid flows from the portions of high pressure to the portions of low pressure. In the region of a low flow rate in which the flow velocity in the tube is low, a flow of liquid is generated along the beads 12, 13, however, in the conventional case, in the region of a low flow rate in which the flow velocity in the tube is low, a flow of liquid is generated on the axial line in the tube. Therefore, the heat radiating performance can be enhanced, and the pressure loss in the tube can be reduced, that is, the effect of facilitating the generation of a turbulent flow can be provided in the region of a low flow rate.

In the region of a high flow rate in which the flow velocity is high in the tube, when the beads 12, 13 are formed in such a manner that the circumference is divided into equal parts, a difference in pressure is generated on the downstream side of the beads, and liquid flows to a portion of low pressure. Therefore, the pressure loss in the tube can be reduced. Concerning the heat radiating performance, since the target of the two-dimensional protrusion itself is the facilitation of the generation of a turbulent flow, when the beads are arranged as described above, the heat radiating performance is seldom affected, that is, the heat radiating performance is seldom deteriorated.

By virtue of the foregoing, since the beads, which are bodies to facilitate the generation of a turbulent flow, are formed and arranged in such a manner that the circumference is divided into equal parts and the phases of the beads 12, 13 adjoining in the axial direction are shifted from each other, even when the pressure loss is reduced in the tube, the effect of facilitating heat transfer is not deteriorated and the heat radiating effect is enhanced.

Second Embodiment

Figure 3A:
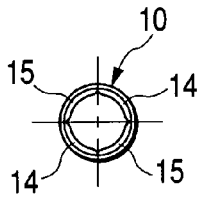
FIG. 3A is a front view.
Figure 3B:
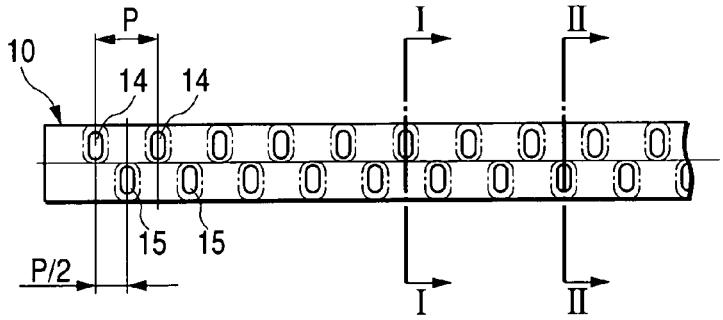
FIG. 3B is a side view and FIG. 3C is a development showing a bead pattern.
Figure 3C:
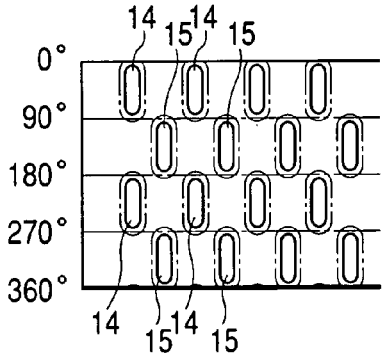
Figure 4A:
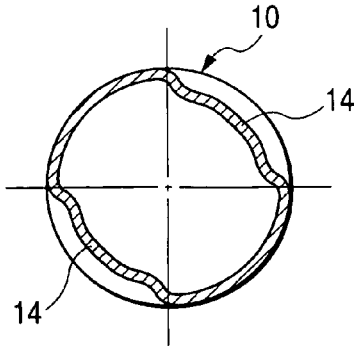
FIG. 4A is a sectional view taken on line I—I in FIG. 3B.
Figure 4B:
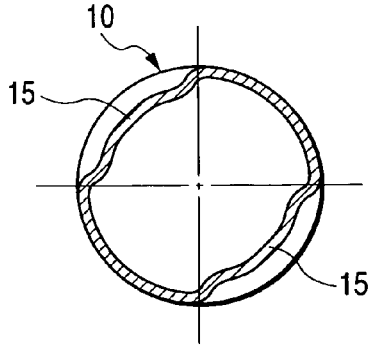
FIG. 4B is a sectional view taken on line II—II in FIG. 3B.

The tube structure of the multitubular heat exchanger of the second embodiment is shown in FIGS. 3 and 4. The beads 14 protruding from the inner face of the tube at the same position in the axial direction are provided in such a manner that the circumference of the tube 10 is divided into four equal parts and the beads 14 are distributed to all the divided positions, which are not adjacent to each other on the same circumference, that is, the beads 14 are distributed to every other divided position. On the circumference at the intermediate position between these beads 14, 14 and the beads 14, 14, which are adjacent to these beads 14, 14, located at a different position in the axial direction, the beads 15, 15 are provided on the same circumference, which is divided into equal parts of an arbitrary number, being distributed to the divided positions not adjacent to each other, in such a manner that the beads 15, 15 are shifted from the beads 14, 14 by the circumferential length of the beads 14, 14 in the circumferential direction. By virtue of the foregoing, when an interval of the beads 14, 14, which are adjacent to each other at the different positions in the axial direction, is one pitch, an interval between the bead 14 and the bead 15, which is located at the intermediate position between the beads 14, 14, is a half (½) pitch.

The beads 14, 15 are provided as described above. When the tube 10 is developed to a plane as shown in FIG. 3C, the beads are arranged as follows. In the ranges of 0° to 90° and 180° to 270° on the circumference, the beads 14, 14 are formed being separate from each other by one pitch in the longitudinal direction of the tube 10. In the ranges of 90° to 180° and 270° to 360° on the circumference, the beads 15 are provided being separate from the beads 14 by a half pitch in the axial direction of the tube 10, and the beads 14 and the beads 15, which are adjacent to each other in the axial direction, are arranged being shifted from each other in the circumferential direction by the length of the bead 14 in the circumferential direction, that is, the beads 14 and the beads 15, which are adjacent to each other in the axial direction, are arranged being shifted from each other in the circumferential direction by the circumferential length of the bead 14, that is, by one fourth of the circumference.

By virtue of the foregoing, since the beads, which are bodies to facilitate the generation of a turbulent flow, are formed and arranged in such a manner that the beads 14, which are adjacent at the different positions in the axial direction, and the beads 15, which are provided on the circumference at the intermediate position, are formed being shifted from each other in the circumferential direction by the length in the circumferential direction of the bead 14 (one fourth of the circumference). Therefore, a distance between the adjoining beads 14, 14 can be extended, and the pressure loss can be effectively reduced, and the heat radiating performance can be enhanced without deteriorating the heat transfer facilitating effect.

In the case where the circumference is divided into equal parts of an even number except four, the pressure loss can be effectively reduced, and the heat radiating performance can be enhanced without deteriorating the heat transfer facilitating effect.

Third Embodiment

Figure 5A:
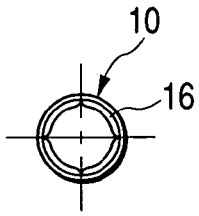
FIG. 5A is a front view.
Figure 5B:
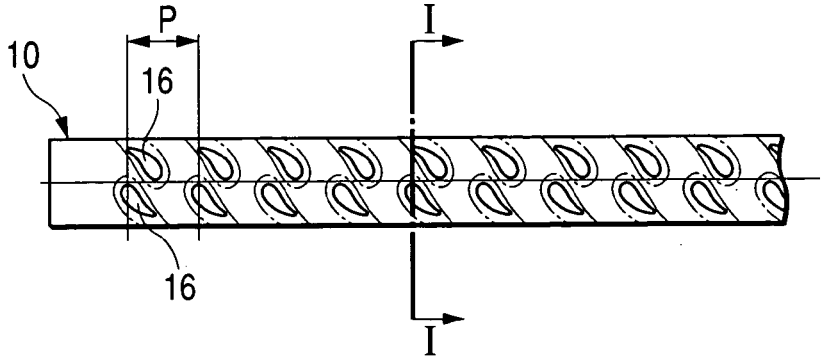
FIG. 5B is a side view and FIG. 5C is a development showing a bead pattern.
Figure 5C:
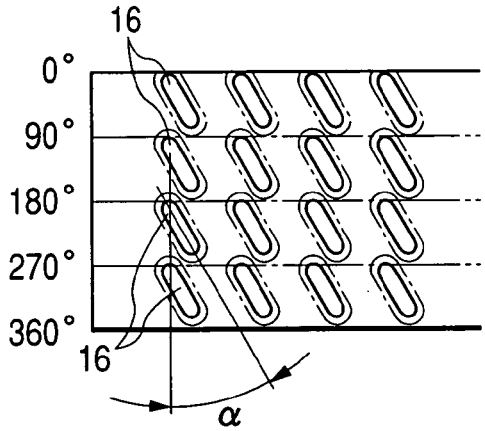
Figure 6:
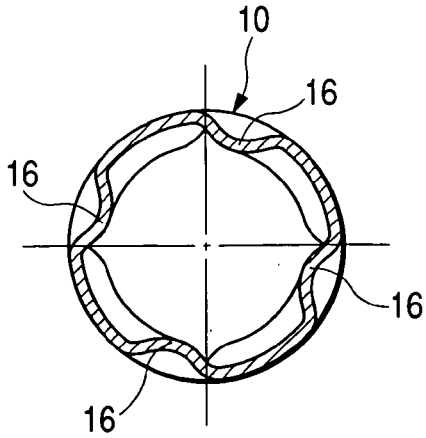
FIG. 6 is a sectional view taken on line I—I in FIG. 5B showing a bead forming portion in the tube structure of the multitubular heat exchanger of the third embodiment.

The tube structure of the multitubular heat exchanger of the third embodiment is shown in FIGS. 5 and 6. The beads 16 protruding from the inner face of the tube at the same position in the axial direction are provided at positions where the circumference of the tube 10 is divided into three or more equal parts (four equal parts in the drawing) in the circumferential direction, being inclined by an arbitrary angle (30° in the drawing) of 45° or less with respect to the circumferential direction.

When the beads 16, . . . , 16 are provided as described above, the tube 10 is developed into a plane as shown in FIG. 5C. The beads 16, . . . , 16 are arranged at positions equally divided in the circumferential direction. The respective beads 16, . . . , 16 are inclined by a predetermined angle with respect to the circumferential direction and formed into a line in the longitudinal direction of the tube 10.

By virtue of the above structure, the thus formed beads 16 are inclined with respect to the circumferential direction. Therefore, the beads, which are bodies to facilitate the generation of a turbulent flow of exhaust gas, maintain the heat transfer facilitating effect and reduce the resisting action. Therefore, the pressure loss can be effectively reduced and the heat radiating performance can be enhanced.

Fourth Embodiment

Figure 7A:
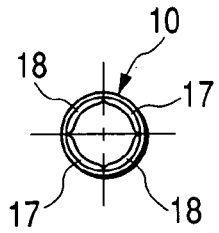
FIG. 7A is a front view.
Figure 7B:
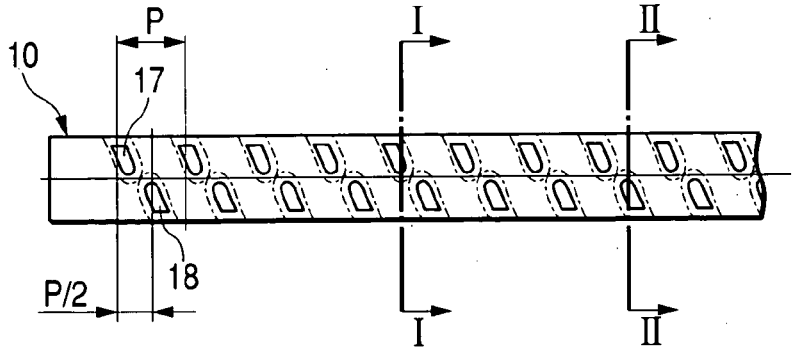
FIG. 7B is a side view and FIG. 7C is a development showing a bead pattern.
Figure 7C:
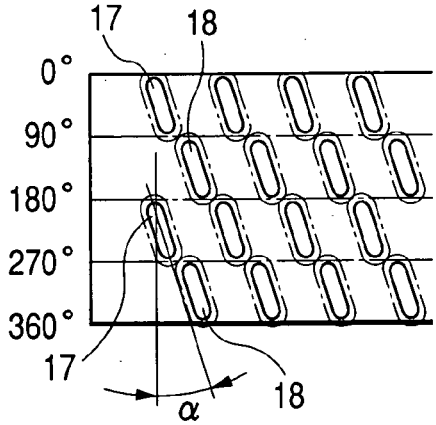
Figure 8A:
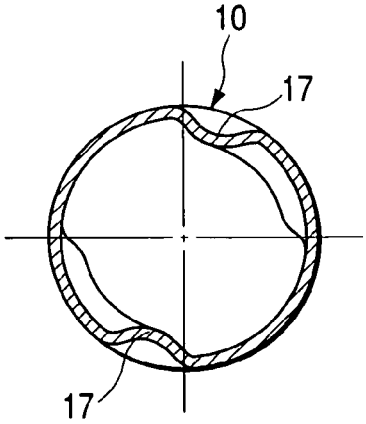
FIG. 8A is a sectional view taken on line I—I in FIG. 7B.
Figure 8B:
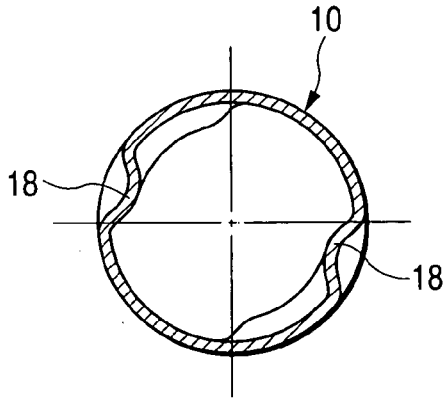
FIG. 8B is a sectional view taken on line II—II in FIG. 7B.

The tube structure of the multitubular heat exchanger of the fourth embodiment is shown in FIGS. 7 and 8. The beads 17 protruding from the inner face of the tube at the same position in the axial direction are provided in such a manner that the circumference of the tube 10 is divided into four equal parts and the beads 17 are distributed to all the divided positions, which are not adjacent to each other on the same circumference, that is, the beads 17 are distributed to every other divided position. On the circumference at the intermediate position between these beads 17, 17 and the beads 17, 17, which are adjacent to these beads 17, 17, located at a different position in the axial direction, the beads 18, 18 are provided on the same circumference, which is divided into equal parts of an arbitrary number, being distributed to the divided positions not adjacent to each other, in such a manner that the beads 18, 18 are shifted from the beads 17, 17 by the circumferential length of the beads 17, 17 in the circumferential direction. All beads 17, 17, 18, 18 are inclined in the same direction by an arbitrary angle (15° in the drawing) of not more than 45° with respect to the circumferential direction. By virtue of the foregoing, when an interval of the beads 17, 17, which are adjacent to each other at the different positions, is one pitch, an interval between the bead 17 and the bead 18, which are located at the intermediate position between the beads 17, 17, is a half (½) pitch.

The beads 17, 18 are provided as described above. When the tube 10 is developed to a plane as shown in FIG. 7C, the beads are arranged as follows. In the ranges of 0° to 90° and 180° to 270° on the circumference, the beads 17, 17 are formed being separate from each other by one pitch in the longitudinal direction of the tube 10. In the ranges of 90° to 180° and 270° to 360° on the circumference, the beads 18 are provided being separate from the beads 17 by a half pitch in the axial direction of the tube 10, and the beads 17 and the beads 18, which are adjacent to each other in the axial direction, are arranged being shifted from each other in the circumferential direction by the length of the beads 17 in the circumferential direction, that is, the beads 17 and the beads 18, which are adjacent to each other in the axial direction, are arranged being shifted from each other in the circumferential direction by one fourth of the circumference. Other points are the same as those of the second embodiment.

By virtue of the above structure, the beads 17, 18 are effectively inclined with respect to the circumferential direction. Therefore, the beads, which are bodies to facilitate the generation of a turbulent flow of exhaust gas, maintain the heat transfer facilitating effect and reduce the resisting action. Therefore, the pressure loss can be effectively reduced and the heat radiating performance can be enhanced.

Fifth Embodiment

Figure 9A:
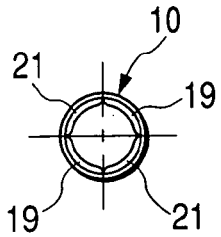
Figure 9B:
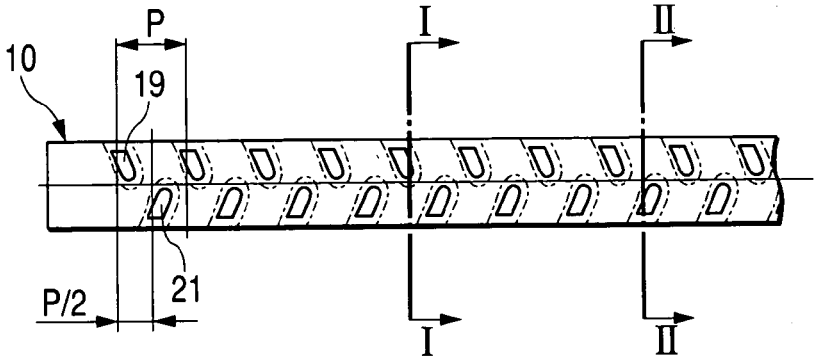
Figure 9C:
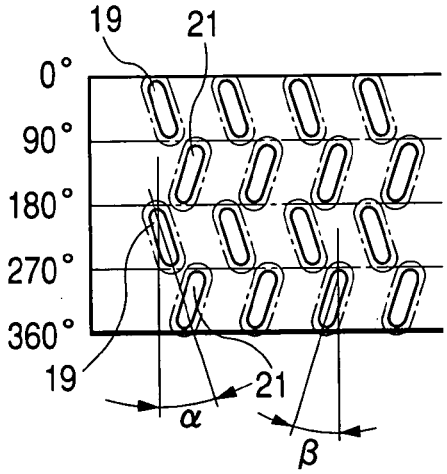
Figure 10A:
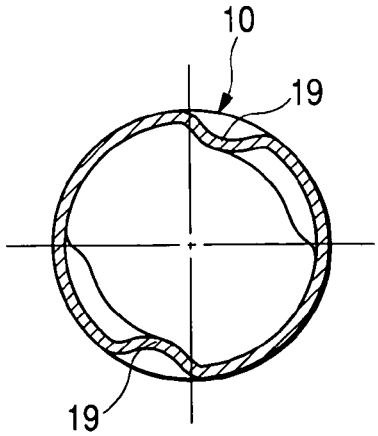
FIG. 10A is a sectional view taken on line I—I in FIG. 9B.
Figure 10B:
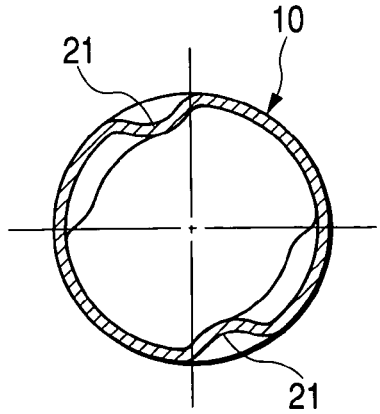
FIG. 10B is a sectional view taken on line II—II in FIG. 9B.

In the tube structure of the multitubular heat exchanger of the fifth embodiment, inclinations of the beads, which are arranged being adjacent to each other in the axial direction, are opposite to each other. The tube structure of the multitubular heat exchanger of the fourth embodiment is shown in FIGS. 9 and 10. The beads 17 protruding from the inner face of the tube at the same position in the axial direction are provided in such a manner that the circumference of the tube 10 is divided into four equal parts and the beads 19 are distributed to the divided positions, which are not adjacent to each other on the same circumference, that is, the beads 19 are distributed to every other divided position. On the circumference at the intermediate position between these beads 19, 19 and the beads 19, 19, which are adjacent to these beads 19, 19, located at a different position in the axial direction, the beads 21, 21 are provided on the same circumference, which is divided into equal parts of an arbitrary number, being distributed to the divided positions not adjacent to each other, in such a manner that the beads 21, 21 are shifted from the beads 19, 19 by the circumferential length of the beads 19, 19. The beads 19, 19, are inclined in the same direction by an arbitrary angle (15° in the drawing) of not more than 45° with respect to the circumferential direction. Further, the beads 21, 21, which are provided while the positions are being shifted, are inclined in the direction opposite to the inclination direction of the beads 19, 19 with respect to the circumferential direction by an arbitrary angle (−15° in the drawing) of 45° or less.

The beads 19, 21 are provided as described above. When the tube 10 is developed to a plane as shown in FIG. 9C, the beads are arranged as follows. In the ranges of 0° to 90° and 180° to 270° on the circumference, the beads 19, 19 are formed being separate from each other by one pitch in the longitudinal direction of the tube 10 being inclined in the same direction. In the ranges of 90° to 180° and 270° to 360° on the circumference, the beads 21 are provided being separate from the beads 19 by a half pitch in the axial direction of the tube 10, and the beads 19 and the beads 21, which are adjacent to each other in the axial direction, are arranged being shifted from each other in the circumferential direction by the length of the bead 19 in the circumferential direction, that is, the beads 19 and the beads 21, which are adjacent to each other in the axial direction, are arranged being shifted from each other in the circumferential direction by one fourth of the circumference. Further, with respect to the circumferential direction, the beads 21, 21 are provided being inclined in the direction opposite to the inclining direction of the beads 19, 19. Other points are the same as those of the second embodiment.

By virtue of the above structure, the beads 19, 21 are effectively inclined with respect to the circumferential direction. Therefore, the beads, which are bodies to facilitate the generation of a turbulent flow of exhaust gas, maintain the heat transfer facilitating effect and reduce the resisting action. Therefore, the pressure loss can be effectively reduced and the heat radiating performance can be enhanced.

Sixth Embodiment

Figure 11:
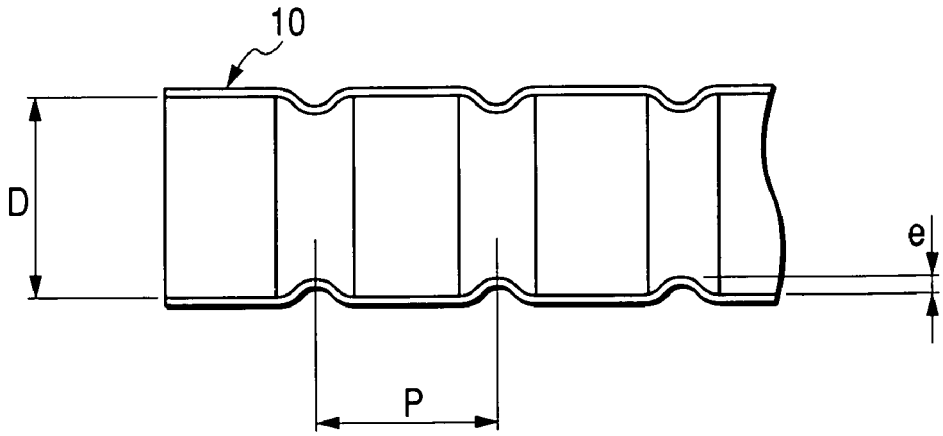
FIG. 11 is a schematic illustration showing a relation between the tube structure of the multitubular heat exchanger of the sixth embodiment of the present invention and the dimensions of the bead.

The tube structure of the multitubular heat exchanger of the sixth embodiment is shown in FIG. 11. As the size of each portion of the tube structure is shown in the drawing, when the inner diameter D of the tube 10 used for a heat transfer tube is 5 to 30 mm, the height e of the bead is set at e=0.05D to 0.2D with respect to the inner diameter D, and the bead pitch P is set at P=6e to 25e with respect to the height e of the bead. This dimensional relationship can be applied to all possible embodiments according to the invention.

By virtue of the foregoing, the beads of the most appropriate dimensions for the use, in which a flow rate of the exhaust gas greatly fluctuates, can be formed. Accordingly, the pressure loss of exhaust gas passing in the tube can be reduced and the heat radiating performance can be enhanced.

Seventh Embodiment

Figure 12:
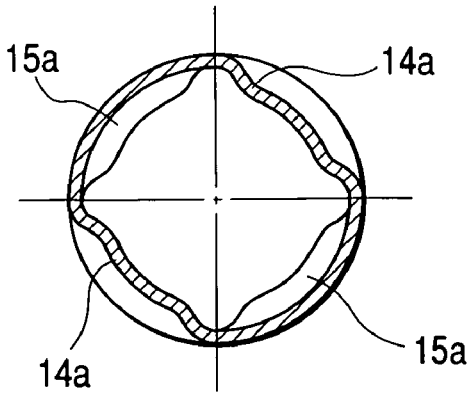
FIG. 12 is a cross-sectional view showing the first variation of the tube structure of the multitubular heat exchanger of the second embodiment of the present invention.
Figure 13:
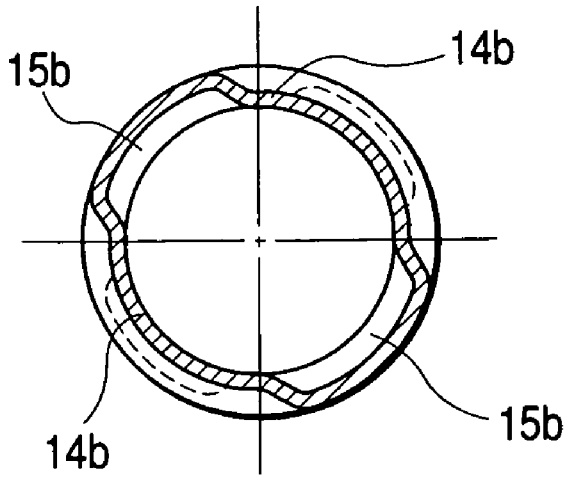
FIG. 13 is a cross-sectional view showing the second variation of the tube structure of the multitubular heat exchanger of the second embodiment of the present invention.
Figure 14:
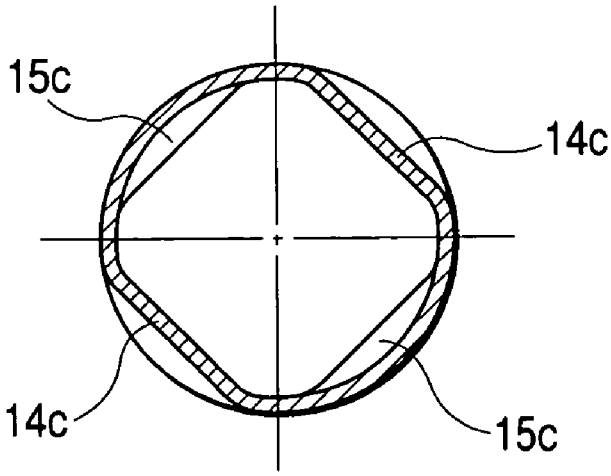
FIG. 14 is a cross-sectional view showing the third variation of the tube structure of the multitubular heat exchanger of the second embodiment . . . of the present invention.

The tube structure of the multitubular heat exchanger of the seventh embodiment can be applied without making a change in the operational effect even when the bead shape is somewhat changed. For example, a variation of the bead shape of the second embodiment is shown as follows. In FIG. 12, non-bead portions are formed at the boundary positions when the cross-sectional shape is equally divided on the circumference, which is referred to as Type 1, hereinafter. In FIG. 13, the beads are overlapped with the boundary position equally divided on the circumference, which is referred to as Type 2, hereinafter. In FIG. 14, the cross-sectional shape of the bead is formed into not an arc but into a straight line, which is referred to as Type 3, hereinafter. These types can be applied to a case in which the circumference is divided into equal parts of an arbitrary even number except four.

In Type 1, the length in the longitudinal direction is formed short so that the beads 14*a* can be provided at the equally divided positions not adjoining on the same circumference of the tube 10 which is divided into four equal parts and so that non-bead portions can be formed at the boundary positions equally divided on the circumference. The beads 15*a*, 15*a*, which are provided on the circumference at the intermediate position between these beads 14*a*, 14*a* and the beads 14*a*, 14*a* adjoining these beads 14*a*, 14*a* at a different position in the axial direction, are formed short in the length of the longitudinal direction.

In the case of Type 2, the circumference of the tube 10 is divided into four equal parts, and the beads 4*b* provided at the equally divided positions, which are not adjacent to each other, on the same circumference are formed long in the longitudinal direction so that the end portions of the beads 4*b* can be formed at the boundary positions which are equally divided on the circumference. The beads 15*b*, 15*b*, which are provided on the circumference at the intermediate position between these beads 14, 14*b* and the beads 14*b*, 14*b* adjoining these beads 14*b*, 14*b* at a different position in the axial direction, are formed long in the longitudinal direction in the same manner so that the beads 14*b*, 15*b* can be formed being overlapped with each other.

In the case of Type 3, the cross-sectional shape of the primary portion of the beads 14*c*, 15*c* to be formed is not an arc formed along the tube wall but a linear shape which is made by means of pressing.

When the above bead type, in which the bead shape is changed, provides the same operational effect as that of the original type, it can be applied.

Figure 15:
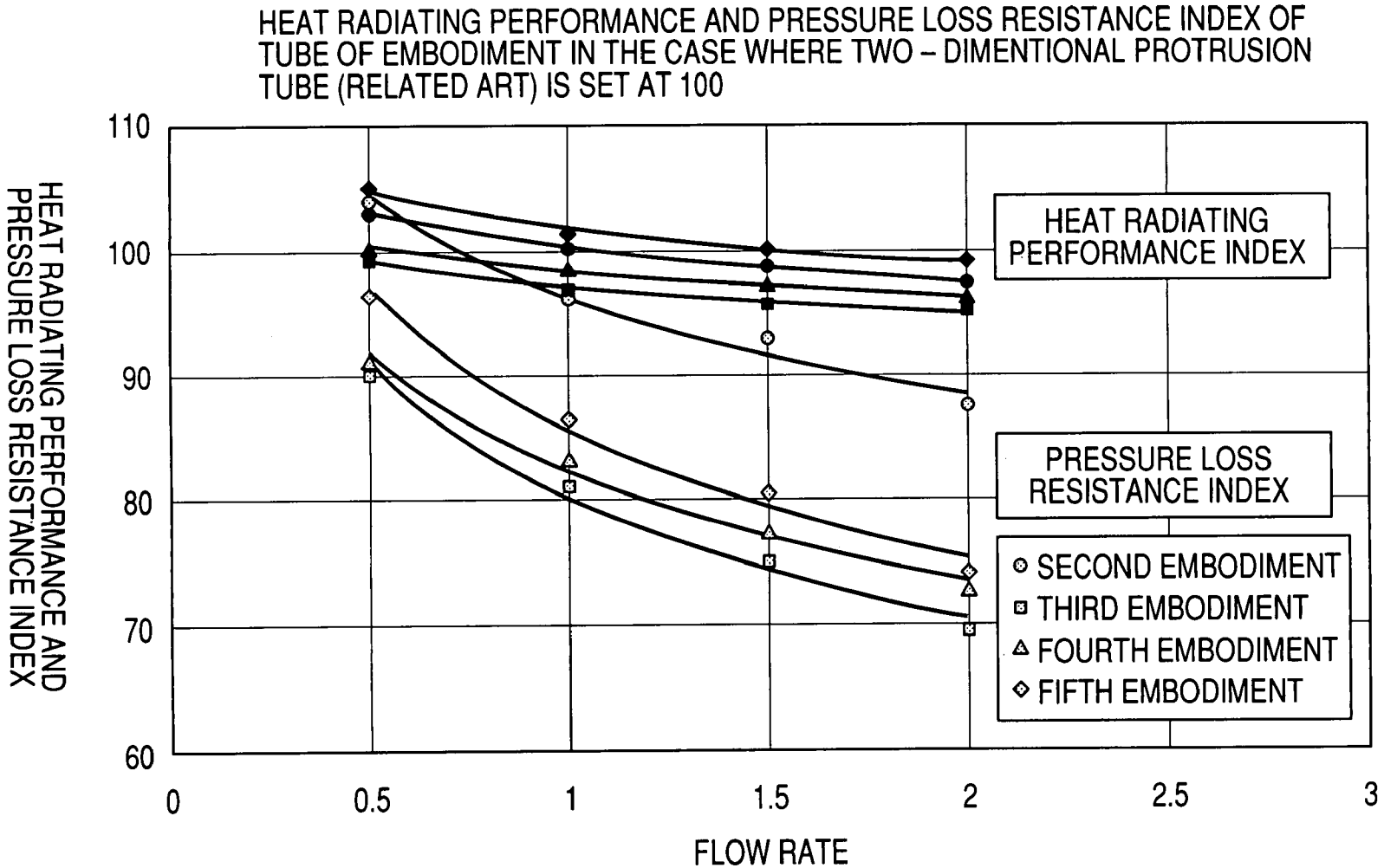
FIG. 15 is a graph showing the heat radiating performance and the pressure loss resistance index of the second to the fifth embodiment of the present invention.
Figure 16A:
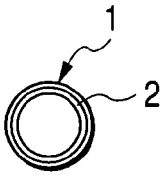
FIG. 16A is a front view and FIG. 16B is a side view.
Figure 16B:
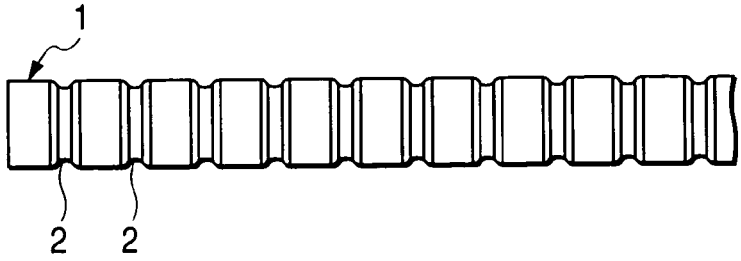
Figure 17A:
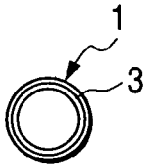
FIG. 17A is a front view and FIG. 17B is a side view.
Figure 17B:
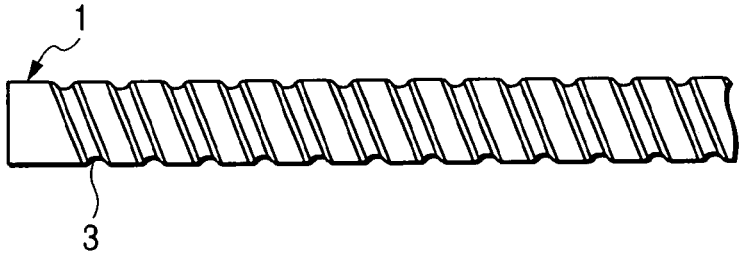
Figure 18A:
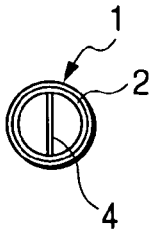
FIG. 18A is a front view and FIG. 18B is a side view.
Figure 18B:
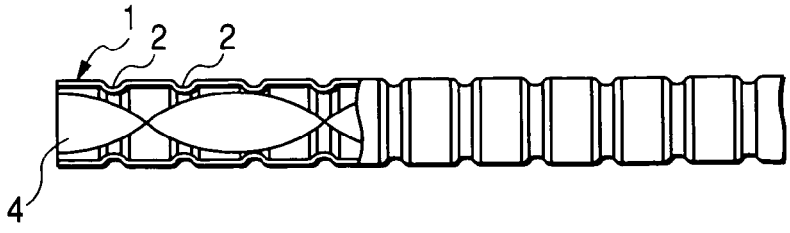

Concerning the characteristics of various bead patterns of the second to the fifth embodiment, relative evaluations of the heat radiating performance and the pressure loss resistance index are shown in FIG. 15 in the case where the heat radiating performance and the pressure loss resistance index of the conventional tube structure having the two-dimensional protrusions are set at 100.

The experiment was conducted on an EGR gas cooler, in which the heated gas (air) is passed through ten tubes and the tubes are cooled by water outside, under the following conditions;

Outer diameter of tube: ϕ12
Tube length: 200 mm
Bead height: 1 mm
Bead pitch: 10 mm
Outer diameter of shell: ϕ54
Water flow rate: 10 L/min
Water inlet temperature: 80° C.
Gas inlet temperature: 500° C.

As a result, the following can be confirmed. When the adjoining beads are shifted from each other in the circumferential direction or the beads are inclined with respect to the circumferential direction, the pressure loss can be reduced and the heat radiating performance can be enhanced without deteriorating the heat transfer facilitating effect.

As described above, in the tube structure of the multitubular heat exchanger according to a first aspect of the invention of the present invention, the shape and the arranging method of the bead, which is a body for facilitating the generation of a turbulent flow, are determined in such a manner that the beads are divided into three or more parts in the circumferential direction and the adjoining beads in the axial direction are arranged so that the phases can be shifted from each other. Therefore, when a flow rate in the tube is low, the heat radiating performance can be enhanced by the effect of facilitating the generation of a turbulent flow while the pressure loss is being maintained to be the same as that of the conventional case in which the beads are uniformly formed on the circumference. As the flow rate in the tube is increased, the heat radiating performance is the same as or lower than that of the conventional tube in which the beads are uniformly formed on the circumference. However, concerning the pressure loss, since the beads are divided, a portion of high pressure generated on the downstream side of the bead is decreased when the beads are divided. Therefore, the pressure loss can be greatly reduced.

In the tube structure of the multitubular heat exchanger of a second aspect of the invention, the dividing number becomes divisible. Therefore, the tube can be easily manufactured, that is, the tube can be manufactured at a low manufacturing cost although the number of beads is relatively large.

In the tube structure of the multitubular heat exchanger of a third aspect of the invention, the beads formed divided into three or more equal parts in the circumferential direction are appropriately inclined with respect to the circumferential direction. Therefore, the flow passage resistance caused by the beads, which are bodies for facilitating the generation of a turbulent flow for the exhaust gas, can be reduced and the pressure loss in the tube can be effectively decreased.

In the tube structure of the multitubular heat exchanger of a fourth aspect of the invention, the shape and the arranging method of the beads, which are bodies for facilitating the generation of a turbulent flow, are determined in such a manner that the beads are formed being shifted in the circumferential direction by the length of the bead in the circumferential direction between the beads, which are adjacent to each other at the different positions in the axial direction, and the beads which are provided on the circumference at the intermediate position of the beads. Therefore, a distance between the adjoining beads at different positions in the axial direction can be extended. Accordingly, the heat radiating performance can be enhanced in the case of a low flow rate, and the pressure loss can be effectively reduced in the case of a high flow rate.

In the tube structure of the multitubular heat exchanger of a fifth aspect of the invention, the beads, which are divided into equal parts by an even number in the circumferential direction, are effectively inclined with respect to the circumferential direction. Therefore, the flow passage resistance caused by the beads, which are bodies for facilitating the generation of a turbulent flow of the exhaust gas, can be reduced and the pressure loss in the tube can be effectively decreased.

In the tube structure of the multitubular heat exchanger of a sixth aspect of the invention, the heat transfer facilitating effect can be effectively enhanced without increasing the resisting action of the beads which are bodies for facilitating the generation of a turbulent flow of the exhaust gas.

In the tube structure of the multitubular heat exchanger of a seventh aspect of the invention, the beads of the most appropriate dimensions for the condition of use, in which a flow rate of the exhaust gas greatly fluctuates, can be formed. Accordingly, the heat radiating performance can be enhanced in the case of a low flow rate of the exhaust gas passing in the tube, and the pressure loss can be effectively reduced in the case of a high flow rate.

The present invention is not limited to the embodiments and the description thereof at all. If various changes which can be easily conceived by those skilled in the art are not departed from the description of the scope of claim, they may be contained in the present invention.

What is claimed is:

1. A tube structure of a multitublar heat exchanger comprising:

a tube;

a plurality of beads protruding from an inner face of the tube, wherein the beads are arranged at a predetermined pitch in an axial direction of the tube; and wherein a bead height e with respect to an inner diameter D of the tube is set at e=0.05D to 0.2D and a bead pitch P with respect to the bead height e is set at P=6e to 25e.

2. The tube structure of a multitubular heat exchanger according to claim 1, wherein a circumference of the tube is divided at least into thirds, and the beads are aligned in a circumferential direction of the tube.

3. The tube structure of a multitubular heat exchanger according to claim 2, wherein the beads aligned in the circumferential direction of the tube are provided at plural rows at the predetermined pitch in the axial direction of the tube, and the beads adjoining in the axial direction are shifted by substantially a half of a circumferential length of the bead to one another.

4. The tube structure of a multitubular heat exchanger according to claim 2, wherein the circumference of the tube is divided into parts of an even number of four or more, and the beads are aligned in the circumferential direction so as to be alternately formed in the parts of the circumference.

5. The tube structure of a multitubular heat exchanger according to claim 2, wherein the beads are inclined by an angle of not more than 45° with respect to the circumferential direction of the tube.

6. The tube structure of a multitublar heat exchanger according to claim 1, wherein the inner diameter D is 5 to 30 mm.

7. The tube structure of a multitubular heat exchanger according to claim 2, wherein inclinations of the beads which are adjacent to each other in the circumferential direction, are made to be opposite.

8. A tube structure of a multitubular heat exchanger comprising:

a tube, an inner surface of which is divided into parts of an even number of four or more; and beads aligned along the axial direction at a predetermined pitch in each part of the inner face, wherein the beads are alternately arranged in the adjacent parts of the inner face of the tube; and wherein a bead height e with respect to an inner diameter D of the tube is set at e=0.05D to 0.2D, and a bead pitch P with respect to the bead height e is set at P=6e to 25e.

9. The tube structure of a multitubular heat exchanger according to claim 8, wherein the beads are inclined by an angle of not more than 45° with respect to the circumferential direction of the tube.

10. The tube structure of a multitubular heat exchanger according to claim 8, wherein inclinations of the beads, which are adjacent to each other in the circumferential direction of the tube, with respect to the circumferential direction are made to be opposite.

11. The tube structure of a multitubular heat exchanger according to claim 8, wherein the inner diameter D is 5 to 30 mm.

12. The tube structure of a multitubular heat exchanger according to claim 8, wherein the beads are alternately aligned along the axial direction at substantially a half of the predetermined pitch.

13. A multitubular heat exchanger including a plurality of heat transfer tubes, through which a heat medium passes for a heat change, each transfer tube comprising:

a tube, an inner surface of which is divided into parts of an even number of four or more; and beads aligned along the axial direction at a predetermined pitch in each part of the inner face, wherein the beads are alternately arranged in the adjacent parts of the inner face of the tube; and wherein a bead height e with respect to an inner diameter D of the tube is set at e=0.05D to 0.2D, and a bead pitch P with respect to the bead height e is set at P=6e to 25e.

14. The multitubular heat exchanger according to claim 13, wherein the beads are inclined by an angle of not more than 45° with respect to a circumferential direction of the tube.

15. The multitubular heat exchanger according to claim 13, wherein inclinations of the beads, which are adjacent to each other in the circumferential direction of the tube, with respect to the circumferential direction are made to be opposite.

16. The multitubular heat exchanger according to claim 13, wherein the inner diameter D is 5 to 30 mm.

17. The multitubular heat exchanger according to claim 16, wherein the beads are alternately aligned along the axial direction at substantially a half of the predetermined pitch.

18. The multitubular heat exchanger according to claim 4, wherein the circumference of the tube is divided into parts of four.

19. The multitubular heat exchanger according to claim 9, wherein the inner surface of the tube is divided into parts of four.

20. The multitubular heat exchanger according to claim 13, wherein the inner surface of the tube is divided into parts of four.

* * * * *